US005090162A

United States Patent [19]

Nelson

[11] Patent Number: 5,090,162

[45] Date of Patent: Feb. 25, 1992

[54] SURFACE TREATING APPARATUS

[76] Inventor: Robert T. Nelson, 12601 Arrowhead Ter., Oklahoma City, Okla. 73120

[21] Appl. No.: 537,409

[22] Filed: Jun. 13, 1990

[51] Int. Cl.[5] ..... B24C 9/00

[52] U.S. Cl. ..... 51/425; 51/424; 51/426; 51/429; 51/432

[58] Field of Search ..... 51/410, 429, 432, 434, 51/424, 425, 426

[56] References Cited

U.S. PATENT DOCUMENTS

| | | | |
|---|---|---|---|
| 209,173 | 10/1878 | Kidwell et al. . | |
| 923,100 | 5/1909 | Young . | |
| 2,159,051 | 5/1939 | Quinn | 51/9 |
| 2,204,610 | 6/1940 | Minich et al. | 51/9 |
| 2,254,234 | 9/1941 | Minich | 51/9 |
| 2,628,456 | 2/1953 | Berg | 51/8 |
| 2,635,284 | 4/1953 | Hunt | 17/11.1 |
| 2,635,745 | 4/1953 | Mead et al. . | |
| 2,684,558 | 7/1954 | Harris et al. | 51/2 |
| 2,766,557 | 10/1956 | Pollard | 51/8 |
| 2,850,162 | 9/1958 | Widmer . | |
| 3,034,262 | 5/1962 | Pawlson | 51/9 |
| 3,262,228 | 7/1966 | Schenck | 51/9 |
| 3,380,196 | 4/1968 | Mabille | 51/9 |
| 3,385,006 | 5/1968 | Miller et al. | 51/8 |
| 3,566,543 | 3/1971 | Fogle . | |
| 3,608,968 | 9/1971 | Burnett | 299/39 |
| 3,704,552 | 12/1972 | Beaver et al. | 51/9 |
| 3,756,377 | 9/1973 | Goff | 198/140 |
| 3,788,010 | 1/1974 | Goff . | |
| 3,877,175 | 4/1975 | Snyder | 51/9 |
| 3,900,969 | 8/1975 | Diehn | 51/9 |
| 3,906,673 | 9/1975 | Goto et al. | 51/9 |
| 3,934,372 | 1/1976 | Diehn et al. | 51/8 |
| 3,934,373 | 1/1976 | Leliaert et al. | 51/9 |
| 3,977,128 | 8/1976 | Goff | 51/9 |
| 3,981,104 | 9/1976 | Dreher | 51/9 |
| 4,020,596 | 5/1977 | Bergh | 51/9 |
| 4,035,958 | 7/1977 | Nishio | 51/425 |
| 4,052,820 | 10/1977 | Bergh | 51/423 |
| 4,202,141 | 5/1980 | Fricke | 51/412 |
| 4,222,205 | 9/1980 | Lake et al. | 51/420 |
| 4,254,593 | 3/1981 | Paulfenerborn | 51/425 |
| 4,336,671 | 6/1982 | Nelson | 51/424 |
| 4,364,823 | 12/1982 | Goff | 209/135 |
| 4,376,358 | 3/1983 | Shelton | 51/429 |
| 4,377,922 | 3/1983 | Bergh | 51/424 |
| 4,377,923 | 3/1983 | Bergh | 51/424 |
| 4,377,924 | 3/1983 | Bergh | 51/429 |
| 4,382,352 | 5/1983 | Nelson | 51/424 |
| 4,416,092 | 11/1983 | Nelson | 51/425 |
| 4,433,511 | 2/1984 | Swain | 51/429 |
| 4,753,052 | 6/1989 | Deckeon | 51/424 |
| 4,894,959 | 1/1990 | Hoover | 51/429 |
| 4,941,296 | 7/1990 | Carpenter | 51/433 |

FOREIGN PATENT DOCUMENTS

| | | | |
|---|---|---|---|
| 0032161 | 5/1979 | European Pat. Off. . | |
| 3338980 | 5/1985 | Fed. Rep. of Germany | 51/425 |
| 487532 | 6/1938 | United Kingdom . | |
| 0002900 | 11/1970 | United Kingdom . | |
| 2070989 | 9/1981 | United Kingdom | 51/425 |
| 2203368 | 3/1988 | United Kingdom . | |
| 2203071 | 10/1988 | United Kingdom | 51/429 |

*Primary Examiner*—Bruce M. Kisliuk
*Assistant Examiner*—John A. Marlott
*Attorney, Agent, or Firm*—Dunlap, Codding, Peterson & Lee

[57] ABSTRACT

A mobile surface treating apparatus having a plurality of nonvertically aligned debris removal means. The apparatus comprises a housing supported on a wheeled platform. An opening in the bottom of the housing defines the area of the surface to be treated. A hopper in the housing collects abrasive material and directs it to the opening. A propeller propels the abrasive material from the hopper toward the opening so that the abrasive material impacts the surface at an angle and rebounds therefrom into a rebound corridor in the housing. From the rebound corridor, the recovered abrasive material is received in a first funnel which delivers the abrasive material in a stream to the first end of a transfer corridor. A propeller or an elevator moves the abrasive material to the second end of the transfer corridor, where it is received in a second funnel. The second funnel empties into the hopper. Air flow intersects the curtains or streams of abrasive material from each funnel and debris is thereby separated and removed form the recovered abrasive material.

17 Claims, 2 Drawing Sheets

SURFACE TREATING APPARATUS

FIELD OF THE INVENTION

The present invention relates generally to devices for treating surfaces. More particularly, the present invention relates to surface treating apparatus in which abrasive material is propelled against the surface to be treated and returned to the apparatus by rebound effect, and thus is recycled continuously during use of the apparatus.

SUMMARY OF THE INVENTION

The present invention comprises an apparatus for treating a surface. The apparatus comprises a housing with an opening that defines the area on the surface to be treated. The housing has a rebound corridor with a first end and a second end. The first end of the rebound corridor forms a part of the opening.

A propeller is supported in the housing for propelling abrasive material toward the opening so as to impact the surface. The propeller is capable of imparting sufficient kinetic energy to the abrasive material to treat the surface and to cause a substantial portion of the abrasive material impacting the surface to rebound a distance from the surface into the rebound corridor.

A debris separation assembly is included in the apparatus. The assembly comprises a first debris separation means, which receives abrasive material from the second end of the rebound corridor, and a second debris separation means, which receives abrasive material from the first debris separation means. The second debris separation means is nonvertically aligned relative to the first debris separation means. Means is provided for moving abrasive material from the first separation means to the second separation means.

The apparatus further comprises a hopper in the housing for receiving abrasive material from the debris separation assembly. The hopper directs the abrasive material to the propeller.

DETAILED DESCRIPTION OF THE PREFERRED EMBODIMENTS

The present invention comprises a surface treating apparatus. Treatment accomplished by this apparatus may include the removal of a coating on a surface or the removal of a portion or layer of the surface itself or both.

The apparatus of this invention is of the type that affects the surface by impacting it with abrasive material, such as metal shot. The shot is thrown at the surface at high speeds sufficient to remove the coating or surface and to impart sufficient kinetic energy to the particles of abrasive material to cause the particles to rebound from the surface back up into the apparatus for recycling.

The rebounding abrasive material is combined with dust, sand and particles removed from the surface, which are referred to herein simply as "debris". Most of the wear on the operative components of these devices is the result of the debris rather than the abrasive material.

The present invention provides an apparatus which separates debris from the returned abrasive material at two or more points during the recycling system. In other words, the recovered abrasive material is cleaned at least twice before it is reused. These multiple cleanings are accomplished in an apparatus which is relatively compact and which employs relatively few moving parts. Thus, the apparatus is more efficient and requires less maintenance and repair.

THE EMBODIMENT OF FIGURE 1

Figure 1:
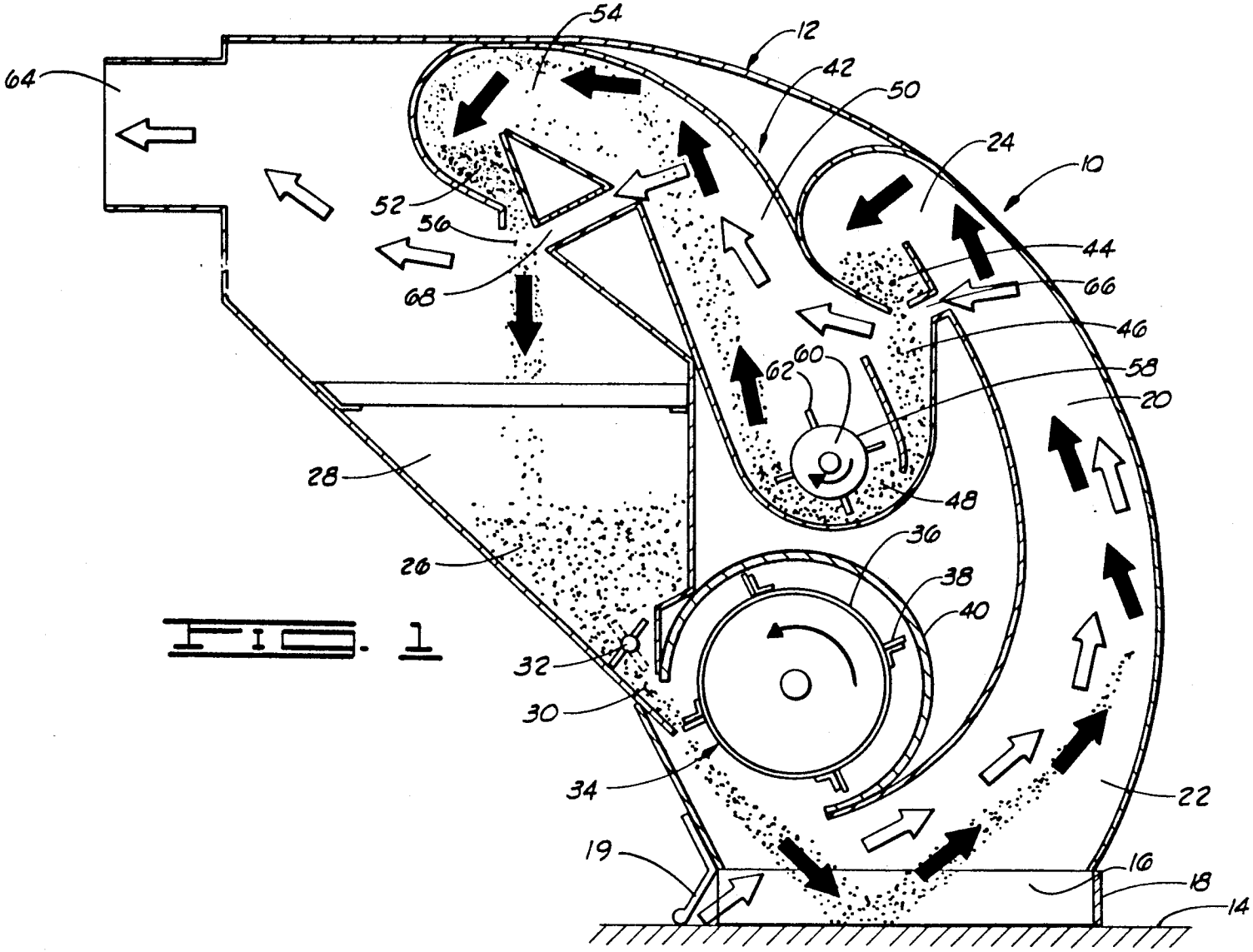
FIG. 1 is a schematic sectional side view of a surface treating apparatus in accordance with one embodiment of the present invention.

Turning now to FIG. 1, there is shown therein a first embodiment of the surface treating apparatus of the present invention designated generally by the reference numeral 10. The apparatus 10 comprises a housing 12 preferably supported on a wheeled platform (not shown) for movement across the surface 14 to be treated.

The housing 12, which is supported a distance over the surface 14, has an opening 16 which defines the area to be treated. Preferably, the opening 16 is surrounded by a skirt 18 which contacts the surface. In this way, the skirt 18 will prevent the escape of debris and abrasive material to the surrounding work area. The rear portion of the skirt 18 comprises a back flap 19.

The housing 12 includes a rebound corridor 20 having a first end 22 and a second end 24. The first end 22 is continuous with and forms a part of the opening 16. The rebound corridor 20 preferably extends a distance up into the housing 12 so that the second end 24 is positioned near the top of the housing. In the preferred embodiments, the rebound corridor 20 is curved and gradually diminishes in internal diameter from the first end 22 to the second end 24.

The apparatus 10 of this invention is of the type that treats a surface by causing abrasive material 26, such as metal shot, to impact the surface 14 at high speed. A hopper 28 is provided in the housing 12 for receiving and holding a volume of abrasive material. The hopper 28 has a neck 30 which is arranged so as to direct the abrasive material flowing therethrough toward the opening 16. A valve 32, such as a pivoted vane or butterfly valve, preferably is included for regulating the flow of the abrasive material 26 through the neck 30.

For imparting a high speed to the abrasive material 26, a propeller 34 is included. As used herein, the term "propeller" denotes a device capable of projecting or throwing the recovered abrasive material 26.

The propeller 34 and the hopper 28 are arranged so as to direct the abrasive material 26 towards the opening 16 to impact the surface 14 at an angle. The propeller 34 is capable of imparting sufficient kinetic energy to the abrasive material 26 to treat the surface 14 and also to cause a substantial portion of the abrasive material to rebound a distance from the surface. In this way, the rebounding abrasive material 26 will be directed up into the rebound corridor 20 for recycling in the apparatus 10 in a manner yet to be described. The path of the abrasive material 26 is indicated in the drawing by solid arrows.

The preferred propeller for practicing the present invention is described in U.S. Pat. No. 4,416,092, issued Nov. 22, 1983 to Nelson, and the contents of this patent are incorporated by reference herein. This preferred propeller 34 generally comprises a rotatable drum 36 typically driven by a motor (not shown) mounted on the platform (not shown) adjacent the housing 12. A plurality of blades, one of which is designated by the reference numeral 38, are circumferentially spaced about the drum 36 and extend radially from the peripheral surface. The propeller 34 usually is enclosed by a protective covering 40 immediately surrounding the propeller 34 in the housing 12.

Other types of propeller devices are known which could be adapted for use in the present invention. One such mechanism is a center-fed, centrifugal blasting wheel. While substantially different in structure and operation, this and other devices are capable of propelling the abrasive material at sufficient speeds to treat the surface and to cause the necessary rebound effect.

As the abrasive material 26 impacts the surface 14, a portion of the surface or coating or both is removed. This produces debris, comprising a combination of paint, dust, sand and particulate matter. To separate and remove the debris from the recovered abrasive material, the apparatus 10 is equipped with a debris separation assembly 42.

The debris separation assembly 42 receives abrasive material 26 from the rebound corridor 20. The assembly 42 comprises a first funnel 44, or some similar structure, for collecting abrasive material from the second end 24 of the rebound corridor 20, which preferably is formed so as to deflect the rebounding abrasive material down into the funnel 44. Abrasive material 26 flows from the first funnel 44 in a stream or curtain 46 which empties into the first end 48 of a transfer corridor 50.

The debris separation assembly 42 further comprises a second funnel 52, or some similar structure, positioned at the second end 54 of the transfer corridor 50 for receiving abrasive material therefrom. Like the first funnel 44, the second funnel 52 is adapted for collecting abrasive material 26 and for discharging the material in a stream or curtain 56. The stream 56 empties into the hopper 28.

The first and second funnels 44 and 52 are nonvertically aligned. That is, one is not directly above the other. In the preferred construction of the apparatus 10, the funnels 44 and 52 are roughly in a side by side arrangement and the transfer corridor 50 is generally vertically disposed, with the first end 48 being under the first funnel 44 and the second end 54 being over the second funnel 52.

For moving the recovered abrasive material through the transfer corridor 50, that is, from the first funnel 44 to the second funnel 52, a propeller 58 is supported in the first end 48 of the transfer corridor 50. The propeller 58 may be of any known construction. As shown, the propeller 58 may comprise a small drum 60 on which a plurality of blades 62 are circumferentially spaced. The propeller 58 need only throw the abrasive material 26 with sufficient force so as to lift or move it to the area of the second funnel 52. The second end 54 of the transfer corridor 50 preferably is formed to deflect the flying abrasive material down into the second funnel 52.

In the preferred practice of the present invention, debris is removed from the recovered abrasive material 26 by air flow. This is possible because the debris is substantially lighter than the abrasive material. Accordingly, the apparatus 10 preferably is adapted to operate with a blower or exhaust fan (not shown), both of which are commonly used for this purpose. An outlet 64 is formed in the housing 12 and is connectable to the blower which in turn delivers the debris to a dust collector (not shown), another device which is well known in the art.

In the apparatus 10, the exhaust fan generates a flow of air through the debris separation assembly 42. More particularly, air is pulled from under or through the back flap 19 of the skirt 18 through the opening 16 and then through the rebound corridor 20. The path of air flow through the apparatus 10 is indicated in the drawings by the hollow arrows. This air flow assists in removing debris from the surface 14 and lifting it into the debris separation assembly 42. It will be appreciated that the abrasive material 26 travels up through the rebound corridor 20 as a result of the kinetic energy imparted to the rebounding material by the propeller 34.

In accordance with the present invention, apertures of some sort are provided to direct the flow of air so that it intersects the streams 46 and 56 from the funnels 44 and 52. To this end, a first passage 66 is formed by the housing 12 between the second end 24 of the rebound corridor 20 and the bottom of the first funnel 44. Similarly, a second passage 68 is formed in the housing 12 between the second end 54 of the transfer corridor 50 and bottom of the second funnel 52.

In this way, the flow of air created by the blower intersects the first stream 46, the upwardly moving abrasive material as it passes through the transfer corridor 50, and the second stream 56. Thus, the removal of debris occurs at three locations in the debris separation assembly 42.

THE EMBODIMENT OF FIGURE 2

Figure 2:
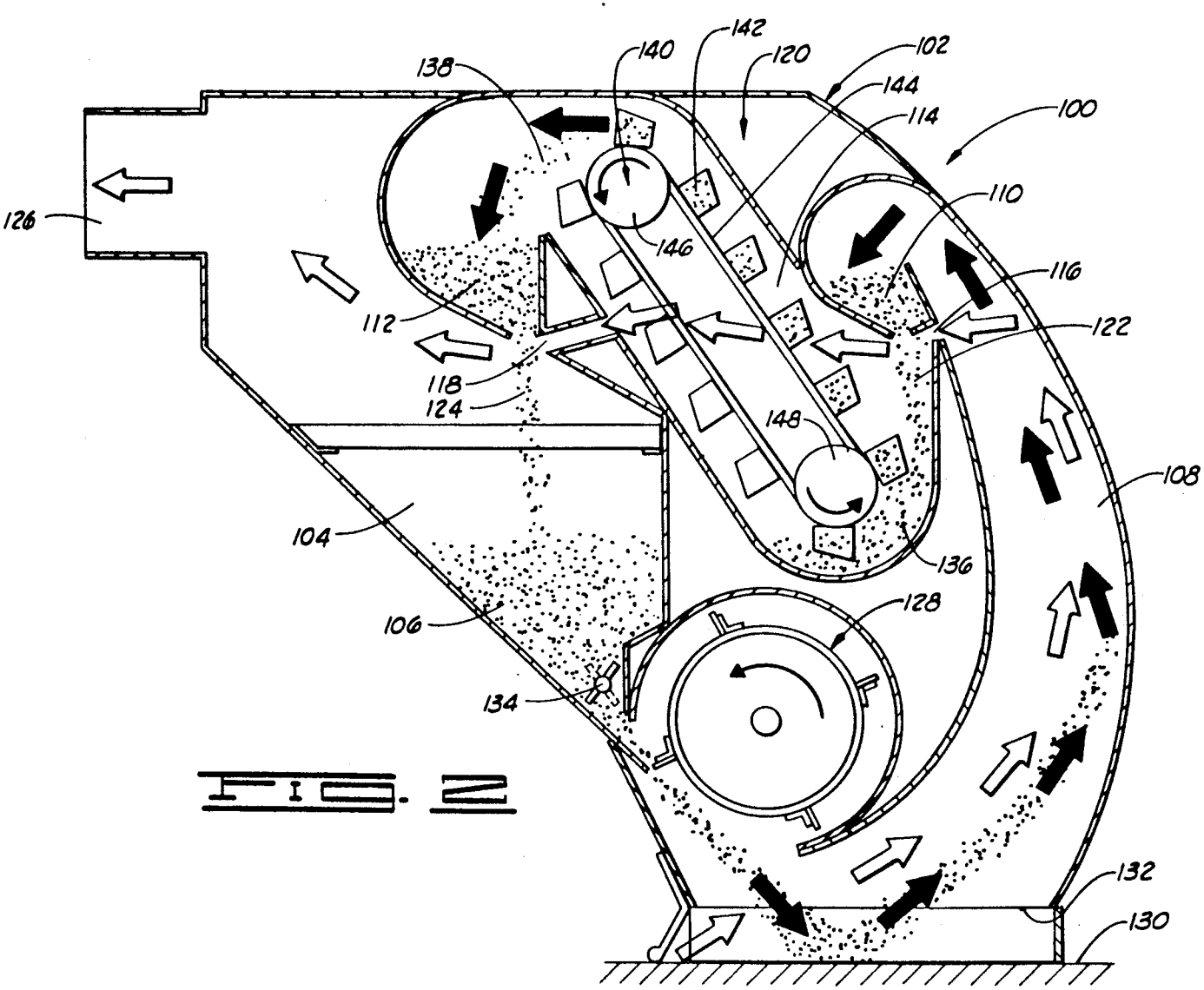
FIG. 2 is a schematic sectional side view of a surface treating apparatus in accordance with a second embodiment of the present invention.

With reference now to FIG. 2, there is shown therein a second embodiment of the surface treating apparatus of the present invention, designated generally by the reference numeral 100. The apparatus 100 generally is constructed like the embodiment shown in FIG. 1. Accordingly, the apparatus 100 comprises a housing 102, a hopper 104 in the housing for holding the abrasive material 106, and a rebound corridor 108.

The apparatus 100 further comprises a first funnel 110 and a second funnel 112 connected by a transfer corridor 114. Air passages 116 and 118 direct air through the debris separation assembly 120 so that the air flow intersects the streams 122 and 124 and carries the debris to a dust collector (not shown) through the outlet 126. Thus, in this embodiment, the abrasive material is twice treated for removal of debris as the air flow intersects the streams 122 and 124.

A first propeller 128 propels abrasive material from the hopper 104 to the surface 130 through an opening 132 which defines the area on the surface to be treated. The flow of abrasive material 106 from the hopper is regulated by a valve 134.

In this embodiment the abrasive material 106 received in the first end 136 of the transfer corridor 114 is moved to the second end 138 of the transfer corridor, and thus delivered to the second funnel 112, by an elevator. As used herein, "elevator" denotes a device which passively lifts the abrasive material.

In the preferred embodiment, the elevator 140 comprises a plurality of buckets, one of which is designated by the reference numeral 142. The buckets 142 are supported on an endless belt 144 rotated in a conventional manner on a pair of spaced apart wheels 146 and 148. Thus, the buckets 142 scoop the abrasive material from the first end 136 of the transfer corridor 114 and dump the abrasive material at the second end 138 of the transfer corridor 114 into the second funnel 112. Of course, the elevator 140 must be constructed in such a manner that the flow air through the transfer corridor 114 is not obstructed substantially thereby.

Changes may be made in the combination and arrangement of the various parts, elements, steps and procedures described herein without departing from the spirit and scope of the invention as defined in the following claims.

I claim:

1. A surface treating apparatus comprising:

a housing with an opening that defines the area on the surface to be treated and a rebound corridor having a first end and a second end, the first end forming a part of the opening;

a propeller supported in the housing for propelling abrasive material toward the opening so as to impact the surface, which propeller is capable of imparting sufficient kinetic energy to the abrasive material to treat the surface and to cause a substantial portion of the abrasive material impacting the surface to rebound a distance from the surface into the rebound corridor;

a debris separation assembly comprising a first debris separation means, which receives abrasive material from the second end of the rebound corridor, a second debris separation means which receives abrasive material from the first debris separation means and which is nonvertically aligned relative to the first debris separation means and which is at about level with or higher than the first debris separation means, and means for moving abrasive material from the first separation means to the second separation means; and a hopper in the housing for receiving abrasive material from the debris separation assembly and for directing the abrasive material to the propeller.

2. The apparatus of claim 1 wherein the propeller comprises a rotatable drum with a plurality of circumferentially spaced blades extending radially from the peripheral surface of the drum.

3. The apparatus of claim 1 further comprising a valve for regulating the flow of abrasive material from the hopper to the propeller.

4. The apparatus of claim 1 wherein the means for moving the abrasive material from the first debris separation means to the second debris separation means comprises a propeller.

5. The apparatus of claim 1 wherein the means for moving the abrasive material from the first debris separation means to the second debris separation means comprises an elevator.

6. The apparatus of claim 1 wherein the apparatus is adapted for operation with means for generating a flow of air through the debris separation assembly and wherein each of the first and second debris separation means comprises:

a funnel which collects abrasive material and from which the abrasive material flows in a stream; and aperture means for causing the flow of air through the debris separation assembly to intersect the stream of abrasive material so that debris is removed thereby.

7. The apparatus of claim 6 wherein the debris separation assembly has a transfer corridor which connects the first debris separation means and the second debris separation means, the transfer corridor having a first end and a second end, and wherein the means for moving the abrasive material from the first debris separation means to the second debris separation means comprises a propeller disposed in the first end of the transfer corridor, which propeller throws the abrasive material towards the second end of the transfer corridor, and wherein the aperture means is further defined as causing the flow of air to intersect the abrasive material as it travels through the transfer corridor towards the second end thereof.

8. The apparatus of claim 6 wherein the means for moving the abrasive material from the first debris separation means to the second debris separation means comprises an elevator.

9. The apparatus of claim 6 wherein the funnel of the first debris separation means is at the second end of the rebound corridor, wherein the second end of the rebound corridor is formed so as to direct the rebounding abrasive material into the funnel, wherein the housing defines a transfer corridor having a first end and a second end, the first end being beneath the funnel of the first debris separation means to receive the stream therefrom and the second end being continuous with the funnel of the second debris separation means, and wherein the means for moving the abrasive material from the first debris separation means to the second debris separation means is in the transfer corridor.

10. The apparatus of claim 9 wherein the means for moving the abrasive material from the first debris separation means to the second debris separation means comprises a propeller.

11. The apparatus of claim 9 wherein the means for moving the abrasive material from the first debris separation means to the second debris separation means comprises an elevator.

12. A surface treating apparatus comprising:

a housing with an opening that defines the area on the surface to be treated and a rebound corridor having a first end and a second end, the first end forming a part of the opening;

a propeller supported in the housing for propelling abrasive material toward the opening so as to impact the surface, which propeller is capable of imparting sufficient kinetic energy to the abrasive material to treat the surface and to cause a substantial portion of the abrasive material impacting the surface to rebound a distance from the surface into the rebound corridor;

a debris separation assembly comprising:

a first debris separation means comprising a funnel which receives abrasive material from the second end of the rebound corridor and from which the abrasive material flows in a stream;

a second debris separation means comprising a funnel which receives abrasive material from the first debris separation means and from which the abrasive material flows in a stream, the second debris separation means being nonvertically aligned relative to the first debris separation means;

a transfer corridor which connects the first and second debris separation means, the transfer corridor having a first end and a second end;

and a propeller disposed in the first end of the transfer corridor for moving abrasive material from the first separation means to the second separation means;

means for adapting the apparatus for operation with means for generating a flow of air through the debris separation assembly;

aperture means for causing the flow of air through the debris separation assembly to intersect the streams of abrasive material from the first and second debris separation means and to intersect the abrasive material as it travels through the transfer corridor, so that debris is removed thereby; and a hopper in the housing for receiving abrasive material from the debris separation assembly and for directing the abrasive material to the propeller.

13. A surface treating apparatus comprising:

a housing with an opening that defines the area on the surface to be treated and a rebound having a first end and a second end, the first end forming a part of the opening;

a propeller supported in the housing for propelling abrasive material toward the opening so as to impact the surface, which propeller is capable of imparting sufficient kinetic energy to the abrasive material to treat the surface and to cause a substantial portion of the abrasive material impacting the surface to rebound a distance from the surface into the rebound corridor;

a debris separation assembly comprising:

a first debris separation means comprising a funnel which receives abrasive material from the second end of the rebound corridor and from which the abrasive material flows in a stream;

a second debris separation means comprising a funnel which receives abrasive material from the first debris separation means and from which the abrasive material flows in a stream, the second debris separation means being nonvertically aligned relative to the first debris separation means; and an elevator for moving abrasive material from the first separation means to the second separation means;

means for adapting the apparatus for operation with means for generating a flow of air through the debris separation assembly;

aperture means for causing the flow of air through the debris separation assembly to intersect the streams of abrasive material from the first and second debris separation means, so that debris is removed thereby; and a hopper in the housing for receiving abrasive material from the debris separation assembly and for directing the abrasive material to the propeller.

14. A surface treating apparatus comprising:

a housing with an opening that defines the area on the surface to be treated and a rebound corridor having a first end and a second end, the first end forming a part of the opening;

a propeller supported in the housing for propelling abrasive material toward the opening so as to impact the surface, which propeller is capable of imparting sufficient kinetic energy to the abrasive material to treat the surface and to cause a substantial portion of the abrasive material impacting the surface to rebound a distance from the surface into the rebound corridor;

a debris separation assembly comprising:

a first debris separation means comprising a funnel which receives abrasive material from the second end of the rebound corridor and from which the abrasive material flows in a stream;

a second debris separation means comprising a funnel which receives abrasive material from the first debris separation means and from which the abrasive material flows in a stream, the second debris separation means being nonvertically aligned relative to the first debris separation means;

a transfer corridor which connects the first and second debris separation means, the transfer corridor having a first end beneath the funnel of the first debris separation means and a second end emptying into the funnel of the second debris separation means; and means disposed in the transfer corridor for moving abrasive material from the first debris separation means to the second debris separation means;

means for adapting the apparatus for operation with means for generating a flow of air through the debris separation assembly;

aperture means for causing the flow of air through the debris separation assembly to intersect the streams of abrasive material from the first and second debris separation means and to intersect the abrasive material as it travels through the transfer corridor, so that debris is removed thereby; and a hopper in the housing for receiving abrasive material from the debris separation assembly and for directing the abrasive material to the propeller.

15. The apparatus of claim 14 wherein the means for moving the abrasive material from the first debris separation means to the second debris separation means comprises a propeller.

16. The apparatus of claim 14 wherein the means for moving the abrasive material from the first debris separation means to the second debris separation means comprises an elevator.

17. A surface treating apparatus comprising:

a housing with an opening that defines the area on the surface to be treated and a rebound corridor having a first end and a second end, the first end forming a part of the opening;

a propeller supported in the housing for propelling abrasive material toward the opening so as to impact the surface, which propeller is capable of imparting sufficient kinetic energy to the abrasive material to treat the surface and to cause a substantial portion of the abrasive material impacting the surface to rebound a distance from the surface into the rebound corridor;

a debris separation assembly comprising:

a first debris separation means comprising a funnel which receives abrasive material from the second end of the rebound corridor and from which the abrasive material flows in a stream;

a second debris separation means comprising a funnel which receives abrasive material from the first debris separation means and from which the abrasive material flows in a stream, the second debris separation means being nonvertically aligned relative to the first debris separation means;

a transfer corridor which connects the first and second debris separation means, the transfer corridor having a first end and a second end; and an elevator disposed in the transfer corridor, for moving abrasive material from the first separation means to the second separation means;

means for adapting the apparatus for operation with means for generating a flow of air through the debris separation assembly;

aperture means for causing the flow of air through the debris separation assembly to intersect the streams of abrasive material from the first and second debris separation means and to intersect the abrasive material as it travels through the transfer corridor, so that debris is removed thereby; and a hopper in the housing for receiving abrasive material from the debris separation assembly and for directing the abrasive material to the propeller.

* * * * *

UNITED STATES PATENT AND TRADEMARK OFFICE

CERTIFICATE OF CORRECTION

PATENT NO. : 5,090,162

DATED : February 25, 1992

INVENTOR(S) : Robert T. Nelson

It is certified that error appears in the above-identified patent and that said Letters Patent is hereby corrected as shown below:

Col. 7, line 15, immediately after the word "rebound", please insert the word -- corridor --.

Signed and Sealed this

Twenty-fifth Day of May, 1993

*Attest:*

*Attesting Officer*

Michael K. Kirk

MICHAEL K. KIRK

*Acting Commissioner of Patents and Trademarks*